United States Patent [19]

Walton

[11] Patent Number: 4,545,736

[45] Date of Patent: Oct. 8, 1985

[54] APPARATUS FOR AUTOMATICALLY PROCESSING SLURRY

[75] Inventor: Francis R. Walton, Longton, England

[73] Assignee: Thomas Willett & Co. Ltd., Stoke-on-Trent, England

[21] Appl. No.: 498,941

[22] Filed: May 27, 1983

[30] Foreign Application Priority Data

Jun. 9, 1982 [GB] United Kingdom ..... 8216765

[51] Int. Cl.[4] ..... F04B 9/10

[52] U.S. Cl. ..... 417/63; 417/290; 417/403; 91/275

[58] Field of Search ..... 417/290, 307, 308, 403, 417/404, 63; 91/275

[56] References Cited

U.S. PATENT DOCUMENTS

| | | | |
|---|---|---|---|
| 2,662,477 | 12/1953 | Logan et al. | 417/290 X |
| 3,344,667 | 10/1967 | Maltby | 91/275 X |
| 3,502,027 | 3/1970 | Avery | 417/308 |
| 3,649,136 | 3/1972 | Ruidisch | 417/404 |
| 3,700,360 | 10/1972 | Shaddock | 91/275 X |
| 4,198,820 | 4/1980 | Roth et al. | 91/275 X |
| 4,256,437 | 3/1981 | Brown | 417/63 X |
| 4,321,016 | 3/1982 | Sakamoto et al. | 417/63 |
| 4,325,127 | 4/1982 | Major | 91/275 X |
| 4,390,324 | 6/1983 | Karliner | 417/307 |
| 4,391,571 | 7/1983 | Craggs | 91/275 X |
| 4,432,698 | 2/1984 | Shirakuma et al. | 417/290 |

FOREIGN PATENT DOCUMENTS

| | | | |
|---|---|---|---|
| 2493421 | 5/1982 | France | 417/290 |

*Primary Examiner*—Leonard E. Smith

*Attorney, Agent, or Firm*—C. O. Marshall, Jr.

[57] ABSTRACT

A reciprocating ram pump of the well known Willett's type is provided with electrical sensors (S1 and S2) and a solenoid operated valve (56) for controlling reversal of the ram at its delivery and suction stroke limits. The sensor outputs are employed for the purpose of counting the number of strokes executed by the ram in a counting circuit (22) which can be preset by means of keyboard (26) to count until a stroke count corresponding to the preset value (or a threshold value close thereto) as been reached whereupon a warning signal may be produced. The number of strokes counted may be indicated on display (28) for example after conversion into a parameter such as total volume delivered. The preset value entered from the keyboard (26) may likewise be displayed. The sensor outputs may additionally be employed to control a timing circuit (24) which can be preset to time a certain interval corresponding to the delivery stroke rate of the pump falling to or below a certain level. In this event, a warning signal may be produced.

9 Claims, 2 Drawing Figures

APPARATUS FOR AUTOMATICALLY PROCESSING SLURRY

BACKGROUND OF THE INVENTION

This invention relates to a reciprocating ram pump of the kind disclosed in, for example, our prior British Pat. No. 677136. This kind of pump comprises a ram mounted for reciprocation in a cylinder having inlet and outlet ports for admission and discharge of the liquid which is to be pumped in response to the suction and delivery strokes of the ram. Reciprocation of the ram is effected by means of a hydraulically operable piston and cylinder device which is controlled by a changeover valve to effect reversal of the ram at the end of each stroke. This kind of pump is widely used for feeding slurries such as clay slip or sewage sludge to pressure type filters and may also be used in transferring liquid/slurries from one point to a remote point. Such a pump is hereinafter referred to as "a reciprocating ram pump of the kind specified".

In the past, the reversal of the ram at the ends of its suction and delivery strokes has been controlled mechanically by means of trip gear actuated by a crosshead which is movable with the ram, the trip gear being arranged to reverse a pilot valve which, in turn, controls the changeover valve for reversing the connections between the piston and cylinder device and a motor driven oil pump.

More recently, the mechanical trip gear has been replaced by electrical sensors, e.g. proximity switches, which are actuated when the ram reaches preset positions and a solenoid operated pilot valve is employed to operate the changeover valve in response to actuation of the electrical switches at each of the limiting positions of the ram.

One of the problems encountered with systems utilising pumps of the kind specified in conjunction with filter presses is the determination of the end point of the treatment cycle. From practical experience, the operator will, in general, be able to calculate at least approximately the volume of slurry that will need to be fed into the press before the desired filter cake consistency is approached. Another parameter which allows the operator to ascertain the approach of the end point is the flow rate into the filter. As the treatment cycle approaches completion, the pressure within the filter gradually increases with consequent reduction in the output of the ram pump.

Measures of the total volume delivered and instantaneous flow rate may be obtained by incorporating a suitable flow rate meter into the system but this would increase the capital costs of the system since reliable flow rate meters tend to be relatively expensive.

SUMMARY OF THE INVENTION

One object of the present invention is to provide a reciprocating ram pump of the kind specified with monitoring means for assisting the operator in, for example, the determination of the end point of a treatment cycle.

According to one aspect of the present invention we provide a reciprocating ram pump of the kind specified comprising electrical sensor means responsive to movement of the ram during its reciprocating cycle and means responsive to the electrical sensor means for controlling the piston and cylinder device to reverse the ram at the limiting positions in its cycle, characterised in that the pump is provided with monitoring means comprising counting means responsive to the sensor means for counting the number of delivery strokes executed by the ram, display means for displaying the counter value as such and/or in terms of the value of a related parameter (such as total volume delivered), user operable means for entry of a preselected value and means for providing an output signal when the two values coincide and/or when the counter derived value reaches a threshold value close to the preselected value.

The output signal may be an audible and/or visual signal and/or it may be used to arrest operation of the pump if desired.

In practice, the user operable entry means may comprise an electronic keyboard whereby the operator may enter into the counter a target count corresponding to the expected total volume of slurry that will need to be delivered before the desired cake consistency is attained. In the preferred embodiment, when the counter-derived value reaches the threshold value (which may be presettable and correspond to a certain volume less than the expected volume needed, or a major proportion of the latter) a warning signal is provided to alert the operator. At this point, the operator may for example update the initially entered value depending on the current state of the treatment cycle. When the preset value (i.e. the value entered initially or the subsequent updated value) is reached a second warning signal is produced to alert the operator to the fact that delivery of the expected volume of slurry has been completed.

The invention makes use of the fact that the ram is of the fixed stroke positive displacement type so that each delivery stroke causes a well defined volume of fluid to be displaced irrespective of the instantaneous speed of the delivery stroke which may vary throughout the treatment cycle. Thus, the number of delivery strokes counted can be readily converted electronically into other parameters such as volume and display it as metric or imperial values.

The pump and monitoring means of the invention may also be used in applications other than filter press feed, e.g. transfer of fluid from a source to a remote point. In this event, the operator may preset the volume of liquid to be transferred and the output signal from the monitoring means may be used to stop the pump when the counter-derived value corresponds to the preset value. At the same time, a warning signal may also be emitted to alert the operator to the fact that the required amount of liquid has been transferred.

According to a second aspect of the invention we provide a reciprocating ram pump of the kind specified comprising electrical sensing means responsive to movement of the ram during its reciprocating cycle and means responsive to the electrical sensor means for controlling the piston and cylinder device to reverse the ram at the limiting positions in its cycle, characterised in that the pump is provided with monitoring means comprising means responsive to said electrical sensor means for detecting when the duration of the delivery stroke of the pump reaches or exceeds a predetermined value.

An electronic timing device may be employed which can be preset, by means of a potentiometer for example, to time out if the ram does not complete a delivery stroke within the preset time interval. In this event, an audible and/or visual warning signal may be produced to alert the operator. The timing device may receive, as an input, the signals from one of the electrical sensors, e.g. that associated with the delivery end point of the ram stroke, and the arrangement may be such that the timing device is reset by each sensor signal if the latter arrives before the timing device completes the timing cycle initiated by the previous sensor signal.

As explained previously, the volume delivered by the ram is constant on each stroke even though the duration of the delivery stroke may vary substantially. Also, the return or suction stroke is of fixed duration so that variation in the overall duration of reciprocation is attributable wholly to variations in the delivery stroke. Thus, a measure of the duration of each delivery stroke can be obtained by using the output from only one of the sensors.

The means for presetting the timing device may be calibrated in terms of volume flow rate if desired since the duration of the delivery stroke determines the flow rate. Thus, if the timing device times out, the flow rate has effectively fallen to or below the preset value.

A further aspect of the invention is concerned with the initial starting phase in the operation of a ram pump of the kind specified. The supply of oil to the hydraulic drive piston for the ram is achieved by means of an electric motor driven pump and associated hydraulic circuitry. To prevent excessive power consumption during initial start up of the electric motor and hence the ram pump, hitherto special and relatively expensive starting gear has been incorporated in the motor supply circuitry. The object of this aspect of the invention is to eliminate the need for special starting gear for the motor by adaptation of the hydraulic circuitry.

According to this aspect of the invention, we provide a pumping system including a ram pump of the kind specified, an electric motor driven oil pump and hydraulic circuitry for supplying oil to the hydraulic drive piston of the ram pump, and a sump, characterised in that the hydraulic circuitry includes an electrically controlled valve which, during the initial starting phase of the system, is operated to divert oil to the sump for a predetermined interval of time whereby the electric motor can attain its optimum speed under substantially no-load conditions, the valve thereafter being operated to allow supply of oil to the hydraulic drive piston.

Preferably said valve is arranged so as to be open when an associated solenoid is de-energised and closed when the solenoid is energised whereby the valve provides a bypass path in the event of an electrical fault. The valve may also form part of a relief valve arrangement which, in normal operation of the pump, relieves when a predetermined pressure is encountered on the pressure side of the pump thereby bypassing at least a proportion of the oil directly back to the sump.

DESCRIPTION OF THE DRAWINGS

The above aspects of the invention will now be described by way of example only with reference to the accompanying drawings, in which.

DESCRIPTION OF PREFERRED EMBODIMENTS

Figure 1:
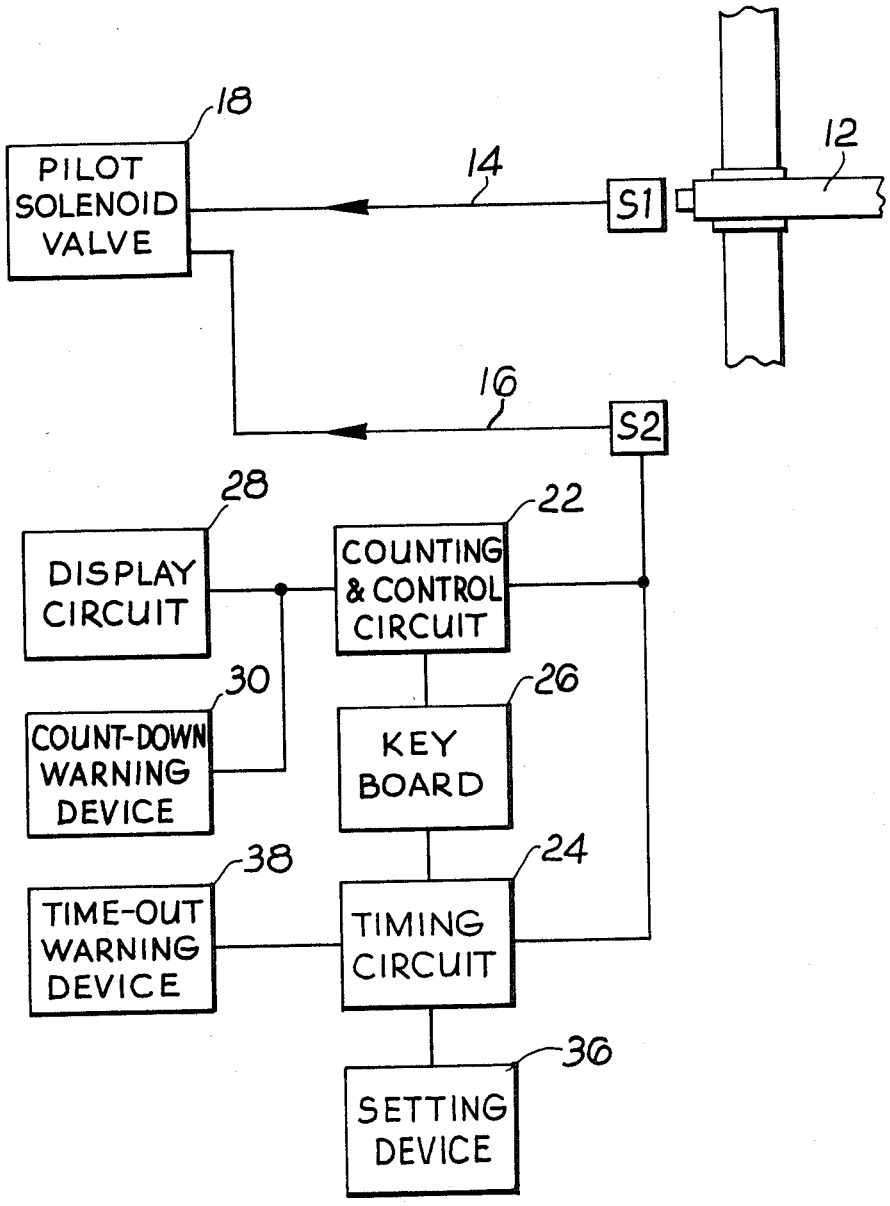
FIG. 1 is a schematic block diagram illustrating monitoring circuitry associated with a ram pump of the Willett's type.

Referring firstly to FIG. 1, the circuitry illustrated is associated with a Willett's pump of the type disclosed in, for example, British Pat. No. 677136. The slidable crosshead of the pump is depicted by reference numeral 12. Instead of actuating mechanical trip gear as in the prior patent, the crosshead cooperates with a pair of proximity switches S1 and S2 so that, at the ends of the stroke of the ram 60, the switches provide electrical outputs via leads 14, 16 which are used to control a solenoid-operated pilot valve 18 (see FIG. 2) for changing over directional valve 20 to reverse the ram 60 at the end of each stroke.

The output from one of the switches, e.g. switch S2, is fed to electronic counting and control circuit 22 and timing circuit 24. Each operation of the switch S2 corresponds to one delivery stroke of the ram and the circuit 22 serves to count the number of switch operations and hence the number of ram delivery strokes. The circuit 22 also receives input from a user operable keyboard 26 by means of which the operator can enter a preset count into the counter which may operate in a countdown mode from the preset value. The preset value entered via the keyboard 26 may be in terms of the number of delivery strokes to be executed by the ram. A display circuit 28 is associated with the circuit 22 for providing a visual indication of stroke count, both as entered by the keyboard 26 and as registered by the counter. Before display, the stroke count values may be converted into their metric and/or imperial volumetric equivalents.

In use, during pump operation, the counter will proceed to countdown from the user-preset value in response to each actuation of the switch S2. At one or more predetermined points during the counting procedure, the circuit 22 may operate a warning device 30. For example, a first warning signal may be produced when the count down reaches a threshold value corresponding for example to the point where the pump has delivered 100 gallons less than the volume forecast by the operator in order to achieve the desired cake consistency in a filter press. A second warning signal may be produced when the counter reaches zero to alert the operator to the fact that the forecast volume has been delivered. At the same time, the circuit may also produce a signal to stop the pump if desired. The timing period of the timing circuit 24 is presettable by a setting device 36 such as a potentiometer which may incorporate a dial calibrated in terms of flow rate. The timer 24 is reset each time the switch S2 is operated unless, in the meantime, the timer 24 completes its preset timing period. In the latter event, the timer triggers a warning device 38 to alert the operator. Thus, provided the duration of each delivery stroke is less than the preset time interval, the timer 24 will continually be reset before it is able to time out and trigger the warning device 38. If the timing device 24 does complete its preset timing cycle and produces the warning signal, this is indicative of the ram either having come to rest or moving at a slower delivery rate than the preset flow rate.

Figure 2:
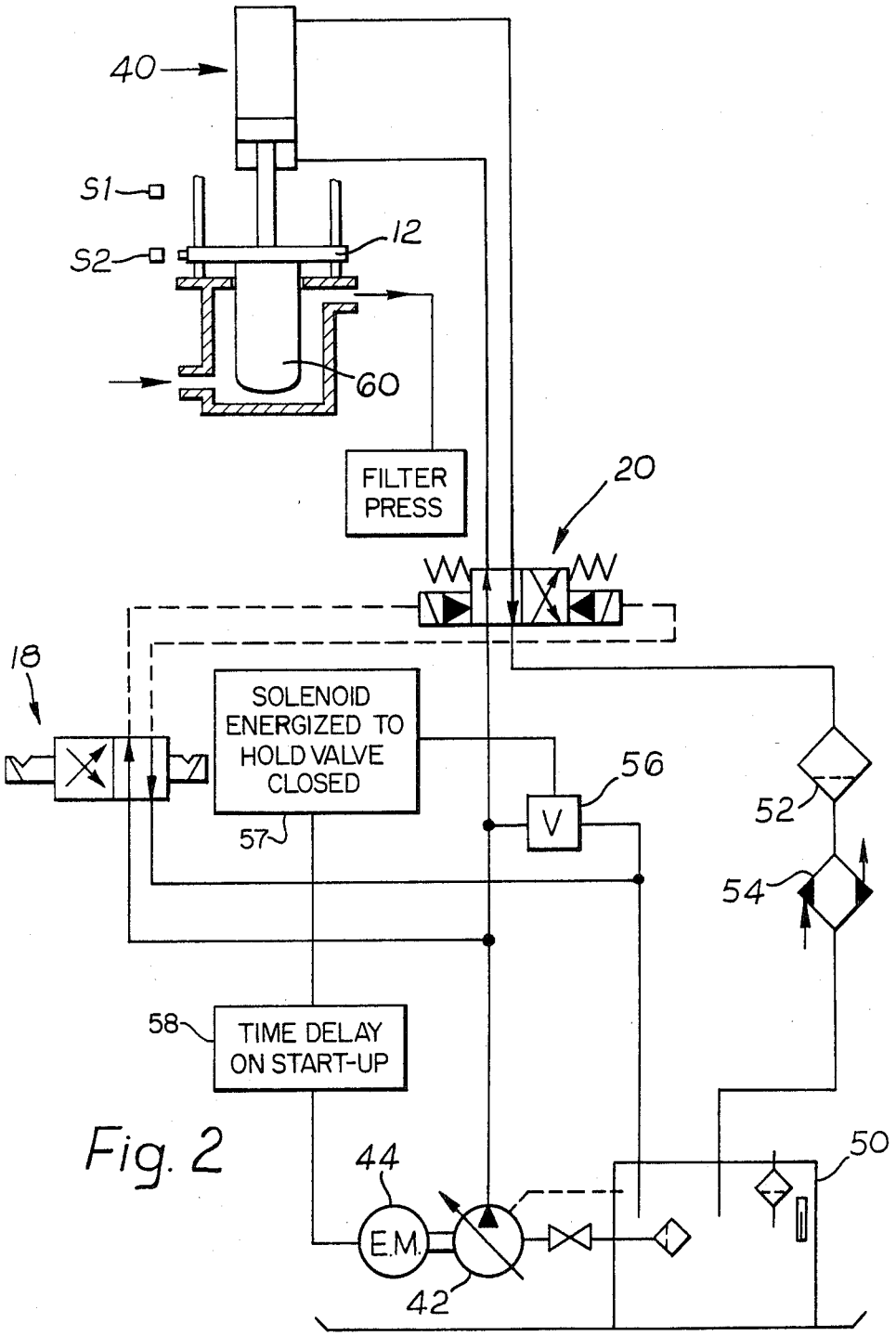
FIG. 2 is a schematic diagram showing, in simplified form, the hydraulic circuitry associated with the ram pump.

Referring now to FIG. 2, the double acting drive piston and cylinder 40 for reciprocating the ram (60) is supplied with oil under pressure from a pressure compensated, variable delivery pump 42 driven by an electric motor 44. In normal operation, the pump 42 supplies the oil via directional valve 20 which is controlled by the solenoid-operated valve 18 so that, each time one of the switches S1 or S2 is operated, the valve 20 changes over to reverse the direction of operation of the piston and cylinder 40 and hence of the ram. The oil returns to sump 50 via cooler 52 54.

To prevent excessive power consumption by the motor and avoid the need for special starting control gear, the hydraulic circuit includes a valve 56 which is connected between the high pressure side of the circuit and the sump to divert oil flow when open. The valve 56 is solenoid operated in such a way that it is closed when the solenoid 57 is energized and open when the solenoid is de-energized. During normal operation of the system, this solenoid is energized to maintain the valve 56 closed. During the initial startup phase of the system however, energisation of the solenoid is delayed for a preset time interval following energisation of the motor 44. The delay time may be determined by a timer 58 which starts timing at the same time as the motor is energised and produces a solenoid-energising signal upon timing out of the preset timing interval. Thus, while the valve 56 is open, the output of the oil pump 42 is diverted via valve 56 back to the sump so that initial operation of the motor takes place under substantially no-load conditions.

The valve 56 may, if desired, constitute the first stage of a two stage valve, the second stage of which, in normal operation of the pumping system, relieves when the pressure on the high pressure side of the circuit exceeds a preselected value thereby providing a bypass path from the oil pump 42 to the sump 50.

I claim:

1. Apparatus for automatically processing slurry in a treatment cycle to produce from the slurry a solid cake of desired consistency, comprising a ram pump including a ram mounted for reciprocation in a cylinder having an inlet for admission of slurry in response to a suction stroke and an outlet for discharge of slurry in response to a delivery stroke of the ram, a processing receiver connected to receive slurry from said outlet, for separating liquid from the slurry under pressure to form a solid cake, a hydraulic cylinder having a piston connected to reciprocate the ram, an electrical means for sensing arrival of the ram at each of its limiting positions, and means responsive to such electrical sensing means for controlling the hydraulic cylinder and piston to reverse the movement of the ram at each of its limiting positions, wherein the improvement comprises a timer which is restarted by at least one of the electrical sensing means, to measure the duration of the delivery stroke of the ram, a device which presets the timer to time out when the duration of the delivery stroke of the ram indicates that the treatment cycle has reached an end point at which the solid cake has the desired consistency, and a device controlled by the timer to generate a signal when the timer times out.

2. Apparatus as claimed in claim 1 wherein the processing receiver is a filter press and the solid cake which is produced is a filter cake formed in the filter press by expulsion of liquid from the slurry.

3. Apparatus as claimed in claim 1 comprising means controlled by the timer for producing an alarm signal when the timer detects such duration of the delivery stroke of the ram.

4. Apparatus as claimed in claim 1 wherein the timer is connected to be restarted by one of the electrical sensing means whenever such sensing means detects arrival of the ram at a limiting position, and is provided with means for producing an alarm signal whenever a predetermined time interval is measured by the timer before such arrival is detected by such sensing means.

5. Apparatus as claimed in claim 1 comprising means responsive to the electrical sensing means for counting the delivery strokes of the ram, means controlled by the counting means for displaying a value which is a function of the number of strokes counted, and means controlled by the counting means for producing an output signal when the number of strokes counted reaches a predetermined value.

6. Apparatus as claimed in claim 5 comprising means controlled by the counting means for displaying the number of strokes counted.

7. Apparatus as claimed in claim 5 in which the counting means is arranged to operate in a count-down mode.

8. Apparatus as claimed in claim 5 in which said output signal comprises a visual warning signal.

9. A pump as claimed in claim 5 in which said output signal comprises an audible warning signal.

* * * * *